United States Patent [19]

Stanzel

[11] 4,133,139

[45] Jan. 9, 1979

[54] JET-PROPELLED MODEL AIRPLANE

[76] Inventor: Victor Stanzel, Schulenburg, Tex. 78956

[21] Appl. No.: 796,541

[22] Filed: May 13, 1977

[51] Int. Cl.[2] ..... A63H 27/04; A63H 27/06

[52] U.S. Cl. ..... 46/249; 46/76 A

[58] Field of Search ..... 46/76 A, 249

[56] References Cited

U.S. PATENT DOCUMENTS

| | | | |
|---|---|---|---|
| 2,439,054 | 4/1948 | Mostof | 46/249 |
| 2,805,349 | 9/1957 | Friedman | 46/249 |
| 3,018,585 | 1/1962 | Stanzel | 46/77 |
| 3,796,005 | 3/1974 | Chang et al. | 46/249 |
| 3,919,805 | 11/1975 | Stanzel | 46/249 |

*Primary Examiner*—Russell R. Kinsey

*Assistant Examiner*—Robert F. Cutting

*Attorney, Agent, or Firm*—Vinson & Elkins

[57] ABSTRACT

A line-controlled, centrifugal fan, jet-propelled model airplane is disclosed in which the impeller of a fan contained within the fuselage of the aircraft is driven from a remote drive unit by an elongated flexible cable contained within a flexible sheath. The impeller rotates about an axis perpendicular to the longitudinal axis of the airplane and is driven in a direction of rotation tending to rotate the airplane about its lateral axis in a nose-up direction, due to the frictional contact of the compressed air between the rotating impeller and the housing of the centrifugal fan mounted within the fuselage. This abstract is not to be construed in any way to define or limit the invention set forth below.

12 Claims, 5 Drawing Figures

16
20
10
22
24
80
18
16
84
83
82
50
41

JET-PROPELLED MODEL AIRPLANE

BACKGROUND OF THE INVENTION

I. Field of the Invention

This invention relates to toy or model aircraft of the type which are remotely powered and remotely controlled in flight and more particularly to a line-controlled flying model airplane having as its motive power a centrifugal fan ejecting a stream of air rearwardly for reactive forward jet propulsion.

II. Description of the Prior Art

U.S. Pat. Nos. 3,018,585 and 3,919,805 disclose prior art remotely powered and controlled model aircraft somewhat similar to those of the present invention, but not possessing the improvements of the present invention.

SUMMARY OF THE INVENTION

This invention relates to improvements in remotely powered and controlled model aircraft of the general type disclosed in U.S. Pat. Nos. 3,018,585 and 3,919,805 wherein the aircraft is powered from a remotely located motor through an elongated flexible drive shaft or cable confined within an elongated flexible sheath or housing. However, unlike the prior art aircraft which are driven by propellers, the present aircraft is jet-propelled by means of a centrifugal fan mounted within the fuselage of the aircraft, the impeller of the fan being driven by the flexible drive shaft from the remotely located motor.

According to one aspect of the invention, the impeller of the centrifugal fan is mounted for rotation about an axis perpendicular to the longitudinal axis of the aircraft fuselage and is rotated in a direction tending to rotate the airplane about its lateral axis in a nose-up direction, due to the frictional contact of the compressed air between the rotating impeller and the housing of the centrifugal fan mounted within the fuselage.

According to another aspect of the invention, the remotely located drive motor includes electrical resistance-type speed control means for the motor to vary the rotational speed of the impeller and consequently vary the rotational force transmitted to the airplane about its lateral axis, to thereby control the climbing and gliding altitude of the airplane in flight, as well as varying the speed of the airplane by varying the amount of thrust imparted by the impeller.

According to another aspect of the invention, the centrifugal fan includes means for producing the sound effect of an actual jet-plane in flight.

DESCRIPTION OF THE DRAWINGS

In the accompanying drawings, which form a part of the application and in which like numerals indicate like parts.

DESCRIPTION OF THE PREFERRED EMBODIMENT

Figures 1, 2:
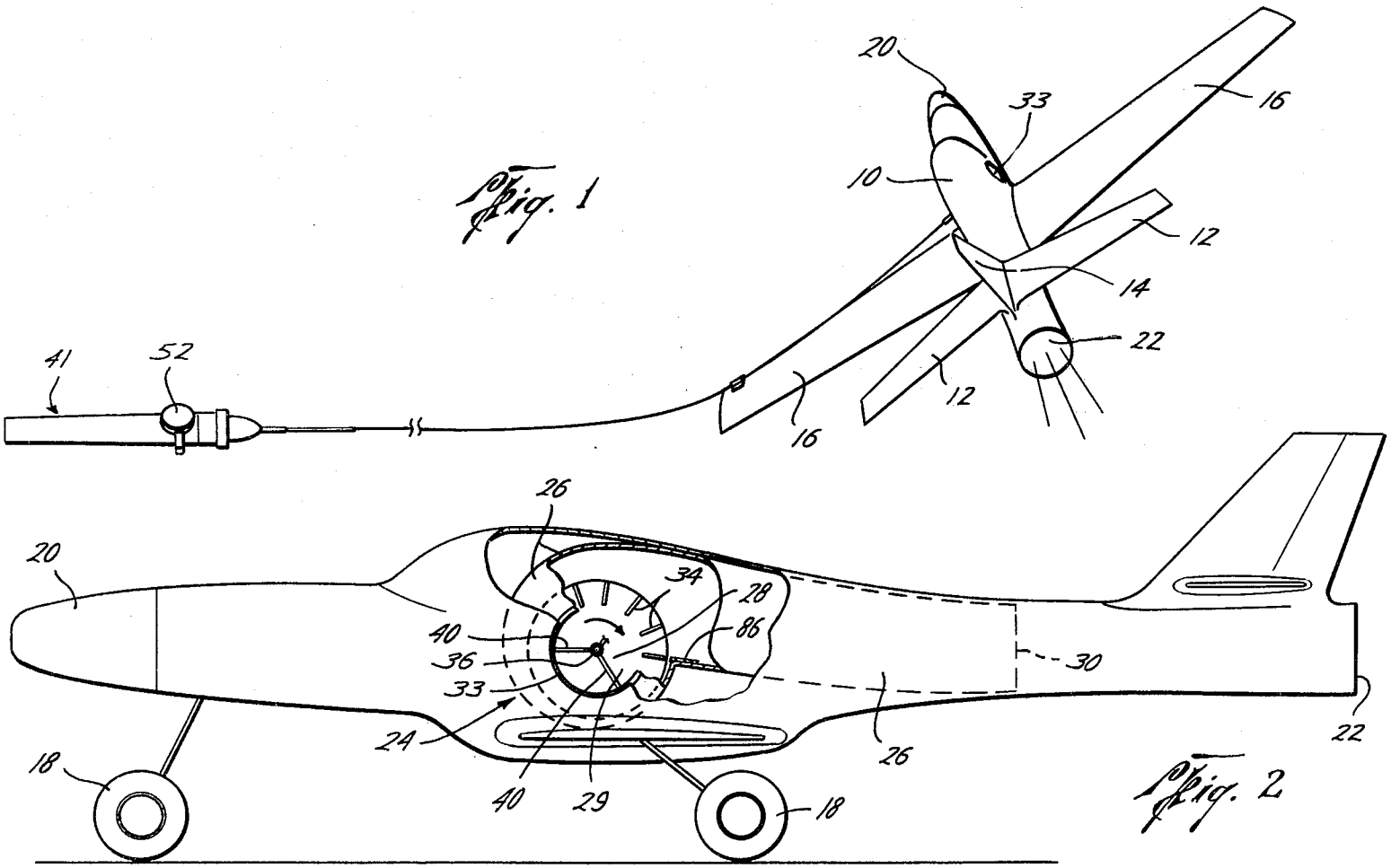
FIG. 1 is a perspective view, illustrating the preferred embodiment of the aircraft of the present invention including the aircraft, the remote drive unit and the connecting flexible drive cable.
FIG. 2 is a vertical view, partly in section, of the aircraft of FIG. 1 illustrating details of the centrifugal drive fan.
Figure 3:
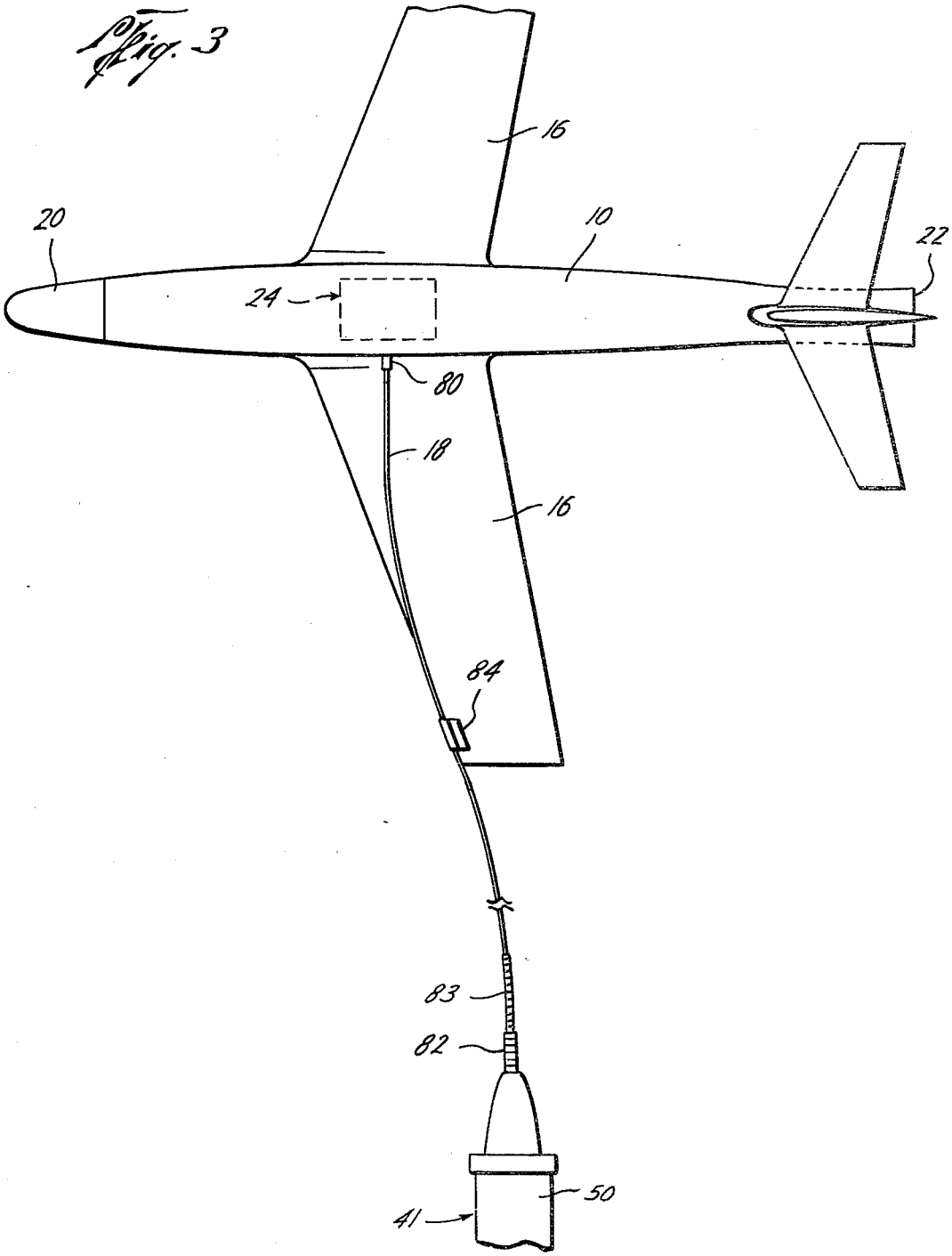
FIG. 3 is a plan view of the aircraft and drive motor of FIG. 1 illustrating details of the connection of the flexible drive shaft and its sheath to the airplane wing to the impeller of the centrifugal drive fan.
Figure 4:
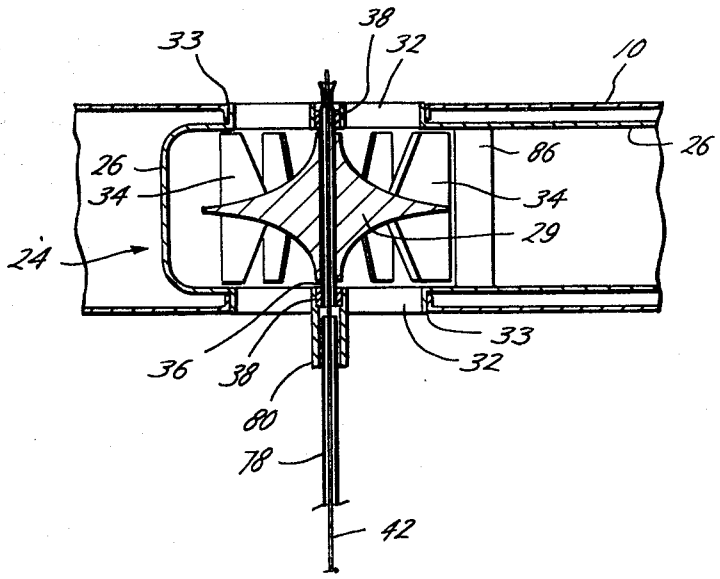
FIG. 4 is a plan view, partly in section, of a portion of the fuselage of the aircraft of FIG. 1 illustrating details of the centrifugal fan and impeller.
Figure 5:
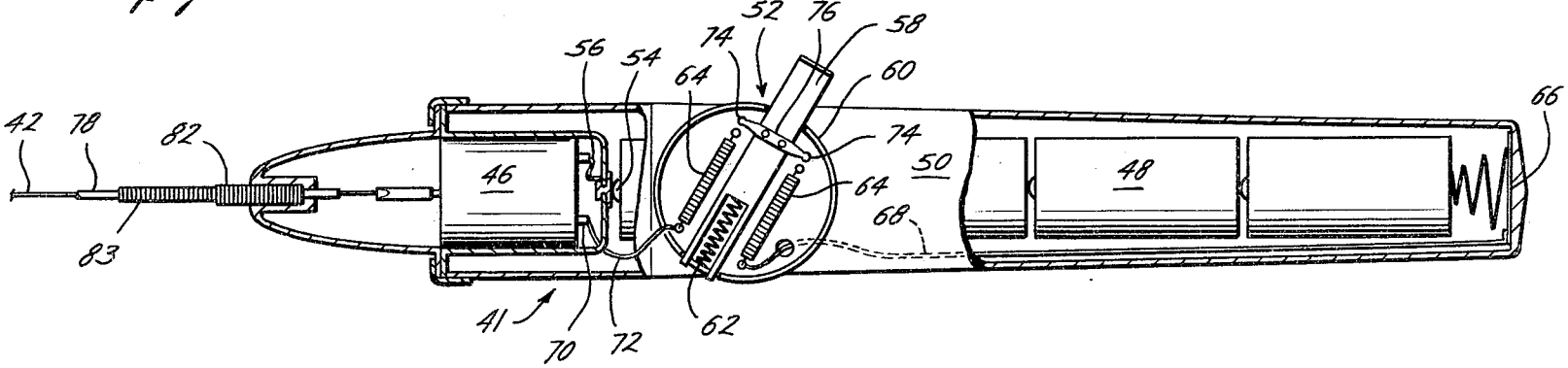
FIG. 5 is a view, partly in vertical section, of the remote drive unit of the apparatus of FIG. 1, illustrating details of the drive motor and of the variable speed control means.

Referring now to FIG. 1, there is shown a model aircraft having a hollow body or fuselage 10, a tail assembly including stabilizers 12 and rudder 14 and wings 16. Conventional tricycle landing gear 18 is provided for take-off and landing.

The airplane is preferrably of very light construction and intended to be aerodynamically self-supporting at relatively low airspeeds. Accordingly, durable but lightweight materials are used in constructing the aircraft with the body 10 and rudder 14 being integrally formed of hollow molded plastic. The wings 16 and stabilizers 12 of the tail assembly are preferrably of balsa wood lamenated between surface layers of paper. The front end of the fuselage is fitted with a resilient foam nose piece 20 to absorb shock or frontal impact and for safety purposes. A simulated jet exhaust opening 22 is formed at the tail end of the fuselage.

Fan means 24 are housed within the fuselage for powering the aircraft. These preferrably comprise a streamlined fan housing 26 and a two-sided impeller 28. The fan housing 26 is fitted into approximately the mid or center section of the fuselage 10 and has an outlet 30 directed rearwardly and connected with the jet exhaust opening 22 at the rear of the fuselage. Circular air intake openings 32 are provided on each side of the fan housing 26. Corresponding air inlet openings 33 are provided in the fuselage 10. As is apparent, the fan housing 26 could, if desired, be formed integrally with the hollow fuselage 10.

The impeller 28 has a generally circular central or body portion 29 with a plurality of vanes or blades 34 mounted perpendicularly thereto and extending outwardly on each side of the central portion 29. The impeller 28 is mounted for rotation about an axis perpendicular to the longitudinal axis of the aircraft body on a small diameter tubular shaft 36. Shaft 36 is rotatably mounted in bearings 38 which are centered in the air intake openings 32 by means of centering struts 40.

The impeller 28 is driven by means of a remote drive unit 41 through a flexible drive shaft or cable 42. Drive shaft 42 has one end suitably connected to the tubular impeller shaft 36, as by swaging 43, so that the impeller 28 will rotate one revolution for each revolution of the flexible drive shaft 42. The opposite end of the flexible drive shaft 42 is suitably connected, as by connector 44, to the drive shaft on an electric motor 46 in the remote drive unit 41. Power for the motor 46 is provided by a plurality of flashlight-type batteries 48. The electric motor 47 and batteries 48 are contained within an elongated cylindrical housing 50 which also serves as the control handle for the airplane.

Details of the construction of the remote drive unit 41, including the motor and battery power pack, are disclosed more fully in U.S. Pat. No. 3,018,585. A difference and improvement of the present unit over that of U.S. Pat. No. 3,018,585 is the provision in the present unit of means 52 for varying the speed of the electric motor 46 in operation, to thereby vary the speed of the flexible drive shaft 42 and impeller 28. One terminal of the motor 46 is electrically connected to the battery supply 48 by connector button 54 and electric lead 56. The other motor terminal is connected to the battery base terminal 66 by leads 68 and 72. The variable speed control means 52, comprising an electrical resistance-type speed controlling unit operated by push-button slider 58 is wired into the electrical circuit between the batteries and the drive motor between the two leads 68 and 72. The speed controlling means consists of a housing 60 attached to, or forming part of, the control handle housing 50 and having the push-button slider 58 slideably mounted thereon. A compression spring 62 is provided to yieldably hold the slider 58 in its neutral (circuit open) position. Two electrical resistance wire coils 64 are fixed to the housing 60 on either side of the slider 58. The bottom end of the one coil is electrically connected to the base terminal 66 of the battery power pack 48 by electric lead 68. The bottom end of the other electric resistance coil 64 is connected to terminal 70 on electric motor 46 by lead 72. Yieldable slider brushes 74, electrically connected to each other by conductor 76 are mounted on the slider 50. Upon depression of the slider 58, the brushes 74 contact, and thereby electrically connect, the resistance coils 64, thus completing an electrical circuit to the drive motor 46. At the uppermost position of contact of the slideable brushes 74 and resistance coils 64, the current delivered to the motor 46 is at its highest point of resistance, causing the motor to run at its slowest speed. As the slider is depressed further, the brushes 74 slide further down the resistance coils 64, thus shortening the length of the resistance wire in the circuit, and consequently decreasing the resistance and increasing the speed of the motor 46. At the fully depressed position of the slider 58, full power of the battery pack is delivered to the motor, causing the motor to run at its highest speed.

The flexible drive shaft 42 is housed within a flexible tubular sheath 78, one end of which is held centrally in a tubular extension 80 surrounding the impeller axle 36 and bearings 38. The other end of the tubular sheath 78 extends into the nose of the drive unit housing 50. Two spiral wound springs 82 and 84 surround the tubular sheath 78 at the point where it enters the housing 50 to prevent sharp bending or kinking of the drive cable at this point. The tubular sheath 78 is also attached to the structure of the airplane by a clip 84 at a point laterally of the longitudinal axis of the airplane, preferrably to the leading edge of the inside wing 16, to thereby impart lateral stability to the airplane during flight.

The apparatus thus described, depression of the slider 58 on the remote drive unit 41 will result in actuation of the electric motor 46 to drive the flexible drive shaft 42, which in turn drives the impeller 28 of the fan 24 to power the aircraft.

It has been found that the rotation of the impeller 28 within the fan housing 26 is effective in transmitting rotative force to the housing and thus to the structure of the airplane into which the housing is fixed, in the same direction of rotation as that of the impeller, due to the friction of the compressed air between the impeller and housing. It has been found, further, that it is important that the impeller be powered to rotate in a direction tending to rotate the airplane in a nose-up direction. For example, viewing the counterclockwise flying airplane from the center of its flying circle, the impeller must be powered to rotate in a clockwise direction. Thus, under power for the takeoff, the nose of the airplane will tend to turn upwardly in a climbing attitude, and with power reduced for a landing, the nose of the airplane will drop for the glide. Consequently, using the variable speed control means 52, the airplane operator can control not only the forward speed of the plane in taxying and in flight, but also the climbing and gliding attitude of the plane in flight, merely by varying the speed of the drive motor and impeller.

It has also been found that the provision in the centrifugal drive fan 24 of a vane or projection 86 mounted in the lower forward portion of the fan housing 26 and having its forward edge parallel, and in close proximity to, the outer edges of the impeller vanes 34 will cause an interruption of the flow of air and thereby produce a high-pitched sound similar to the sound of a real jet engine.

The foregoing disclosure and description of the invention is illustrative and explanatory thereof, and various changes in the size, shape and materials, as well as in the details of the illustrated embodiment, may be made within the scope of the appended claims without departing from the spirit of the invention.

What is claimed is:

1. A toy aircraft comprising:

an elongated body having wings and a tail assembly attached thereto;

centrifugal fan means housed within said body for powering said aircraft, said fan means adapted to rotate about an axis perpendicular to the longitudinal axis of the aircraft body;

a remote drive unit for driving said fan means;

an elongated flexible drive cable extending between and operatively connected to said remote drive unit and said centrifugal fan means for rotatably driving said centrifugal fan means from said drive unit.

2. The apparatus according to claim 1 comprising additionally, an elongated flexible sheath extending between said airplane body and said remote drive unit is surrounding relationship to said flexible drive cable.

3. The apparatus according to claim 1 wherein said remote drive unit includes variable speed control means for varying the speed at which said remote drive unit drives said fan means.

4. The apparatus according to claim 1 wherein said aircraft body includes air inlet means on said body and air outlet means at the rear of said body simulating a jet engine exhaust outlet, and wherein said fan means comprise, a fan housing within said body and adapted to channel air from said air inlet opening in said body to said air outlet and centrifugal impeller means mounted within said fan housing for rotation about an axis perpendicular to the longitudinal axis of the aircraft body and operatively connected to said flexible drive shaft, for forcing air from said air inlet in said body, through said fan housing and out of said air outlet to thereby produce the drive thrust for said aircraft.

5. The apparatus according to claim 4 wherein said impeller includes a plurality of vanes extending parallel to its own axis of rotation and perpendicular to the longitudinal axis of said aircraft body.

6. The apparatus according to claim 4 wherein said impeller is adapted to be rotated by said flexible cable and remote drive unit in a direction tending to rotate the airplane about its lateral axis in a nose-up direction.

7. The apparatus according to claim 4 wherein said fan means includes additional airflow interrupter means mounted in said housing for interrupting the flow of air through said housing to thereby simulate the noise of a jet engine.

8. A model aircraft comprising:

a body having at least one air inlet opening on the side thereof, and an air outlet opening on the rear end thereof simulating a jet exhaust;

wings, a tail assembly and landing gear suitably attached to said body;

centrifugal fan means housed within said body and adapted to rotate about an axis perpendicular to the longitudinal axis of the aircraft body to compress air taken in through said air inlet opening and to direct said compressed air rearwardly through said air outlet opening for reactive forward jet propulsion of said aircraft;

a remote drive unit for powering said fan means;

elongated flexible drive shaft means interconnecting said remote drive unit and said fan means; and variable speed control means on said remote drive unit for controlling the speed at which said fan means are driven by said remote drive unit.

9. The apparatus according to claim 8 wherein said remote drive unit comprises a direct current electric motor operatively connected by electrical circuit means to a direct current power supply and wherein said variable speed control means comprise means for varying the electrical resistance in said circuit interconnecting said motor and power supply.

10. The apparatus according to claim 9 wherein said variable resistance means comprise an electrical resistance coil and an adjustable means for completing said circuit through varying lengths of said coil.

11. The apparatus according to claim 8 wherein the body of said aircraft includes a nose of resilient, shock absorbing material.

12. The apparatus according to claim 8 wherein the fan means is powered in a direction tending to rotate the body of said airplane about is lateral axis in a nose-up direction.

* * * * *